United States Patent [19]

Instone et al.

[11] Patent Number: 5,041,234

[45] Date of Patent: Aug. 20, 1991

[54] TRANSPARENT SOAP BARS WHICH MAY CONTAIN SHORT CHAIN MONOHYDRIC ALCOHOLS, AND A METHOD OF MAKING THE SAME

[75] Inventors: Terry Instone, Bromborough, England; Marco Bottarelli, Campalto, Italy

[73] Assignee: Lever Brothers Company, Division of Conopco Inc., New York, N.Y.

[21] Appl. No.: 330,558

[22] Filed: Mar. 30, 1989

[30] Foreign Application Priority Data

Mar. 31, 1988 [GB] United Kingdom ..... 8807754.0

[51] Int. Cl.[5] ..... C11D 17/02; C11D 9/26; C11D 9/30; C11D 13/16

[52] U.S. Cl. ..... 252/118; 252/93; 252/117; 252/122; 252/134; 252/170; 252/174; 252/368; 252/370; 252/548; 252/DIG. 5; 252/DIG. 16

[58] Field of Search ..... 252/DIG. 5, DIG. 16, 252/367, 368, 369, 370, 170, 174, 117, 118, 122, 93, 134, 548

[56] References Cited

U.S. PATENT DOCUMENTS

| | | | |
|---|---|---|---|
| 2,031,853 | 2/1936 | Potts | 252/93 |
| 2,404,298 | 7/1946 | Kroll et al. | 252/117 |
| 2,820,768 | 1/1958 | Fromont | 252/118 |
| 3,149,188 | 9/1964 | Schmitt | 264/267 |
| 3,562,167 | 2/1971 | Kamen | 252/DIG. 16 |
| 3,793,214 | 2/1974 | O'Neill et al. | 252/117 |
| 3,926,828 | 12/1975 | O'Neill et al. | 252/117 |
| 4,165,293 | 8/1979 | Gordon | 252/118 |
| 4,206,069 | 6/1980 | Borrello | 252/122 |
| 4,273,684 | 6/1981 | Nagashima et al. | 252/DIG. 16 |
| 4,297,230 | 10/1981 | Rasser | 252/DIG. 16 |
| 4,468,338 | 8/1984 | Lindberg | 252/368 |
| 4,490,280 | 12/1984 | Joshi et al. | 252/368 |
| 4,493,786 | 1/1985 | Joshi | 252/368 |
| 4,584,126 | 4/1986 | Joshi | 252/368 |
| 4,647,394 | 3/1987 | Kimura et al. | 252/DIG. 16 |

FOREIGN PATENT DOCUMENTS

| | | | |
|---|---|---|---|
| 0071987 | 2/1983 | European Pat. Off. . | |
| 355026A1 | 10/1990 | European Pat. Off. . | |
| 1149846 | 6/1963 | Fed. Rep. of Germany . | |
| 61-26699 | 2/1986 | Japan | 252/370 |

OTHER PUBLICATIONS

English Translation of German Patent No. 1,149,846.

*Primary Examiner*—Paul Lieberman
*Assistant Examiner*—A. Beadles-Hay
*Attorney, Agent, or Firm*—James J. Farrell

[57] ABSTRACT

A transparent soap composition in bar form comprises with respect to the total composition 40 to 65 wt % of a soap mixture and 60 to 35 wt % of a solvent system. The solvent system includes with respect to the total composition 5 to 15 wt % short chain (C<4) monohydric alcohol or a mixture of said monohydric alcohols, 5 to 20 wt % water and 15 to 40 wt % of a mixture of trialkanolamine and polyol or blend of polyols, the said mixture having a ratio in weight terms of trialkanolamine to polyol or polyols lying within the range 1:3 to 1:0.25, the total composition comprising not more than 20 wt % trialkanolamine. The resulting soap bar has good transparency in combination with user properties approaching those of an ordinary opaque soap bar. The present transparent soap bar can be made by forming an isotropic transparent melt of the composition, casting the melt into moulds and allowing the melt to set. Suitably the melt is retained in the moulds, which are preferably in the form of a pack comprising flexible film material, as an air-tight storage means.

13 Claims, No Drawings

TRANSPARENT SOAP BARS WHICH MAY CONTAIN SHORT CHAIN MONOHYDRIC ALCOHOLS, AND A METHOD OF MAKING THE SAME

The present invention relates to transparent soap bars.

Soap bars which are transparent have an aesthetic appeal to consumers. In some instances consumers also associate transparency with "naturalness" which is a benefit in the eyes of the consumer. There is therefore a demand for transparent soap bars.

Many proposals have been made in the past for methods of manufacture of transparent soap bars. The traditional method of making transparent soap comprises making a solution of soap and other ingredients in a volatile solvent, commonly ethanol, casting the solution into moulds or frames and allowing the volatile solvent to evaporate so as to provide set bars of soap. When first cast the set soap solution is intially semi-opaque and loss of solvent on evaporation is necessary to give transparency. Evaporation can however commonly amount to more than 15 wt % of the original solution and can take a number of months. The so-called casting method thus tends to be associated with potentially mis-shapen bars due to the inevitable shrinkage away from the sides of the moulds that occurs during the evaporation and setting stage, and that can continue to occur after packaging, and with expensive methods of manufacture due the time taken for evaporation to occur. The resulting bars moreover although being deemed transparent tend to be not only more costly than ordinary opaque soap bars, but also to have inferior user properties. In particular the bars can develop an unsightly sticky opaque surface layer on contact with water and can additionally have a relatively high alkalinity which can cause skin dryness in use.

An early attempt to overcome some of these problems is disclosed in U.S. Pat. No. 2820768 (Fromont). U.S. Pat. No. 2820768 dates from 1958 and teaches a transparent, substantially non-alkaline soap comprising a mixture of a transparent alkali metal soap and the product of a free fatty acid ($C > 18$) and excess triethanolamine, the mole ratio of triethanolamine to free fatty acid being between 2:1 and 3:1. The bars are made by mixing the ingredients together and heating the mixture to 100° to 120° C. until a homogeneous transparency is obtained which is maintained on cooling and a pH value of approximately 7.5 in 10% aqueous solution. The heated mixture is then run into frames, cooled, cut and pressed into cakes or bars. U.S. Pat. No. 2820768 thus provides transparent soap bars and a method of making them which not only claims to remove the alkalinity problem with the traditional method, but also deliberately avoids the use of the ethanol and the long evaporation period otherwise needed and its associated problems.

Bars produced according to the U.S. Pat. No. 2820768 method are available commercially under the name "Neutrogena". In use however the bars can suffer from a number of visual and tactile problems. In particular the surface of the bars can become sticky and develop an opaque surface layer following contact with water.

There have been a number of later attempts to employ the concept of the use of excess triethanolamine to provide cast transparent soap bars having allegedly improved properties. Examples of these disclosures can be found in U.S. Pat. No. 3739214 (Avon Products, Inc), U.S. Pat. No. 4206069 (Colgate-Palmolive), U.S. Pat. No. 4468338 (Purex Corporation) and EP71987 (Armour Dial, Inc). None of the resulting soap bars can however be said to have fully acceptable user properties.

It is an object of the present invention to provide a transparent soap bar having improved user properties. It is a further object of the present invention to provide a transparent soap bar having user properties approaching those of an ordinary opaque soap bar. It is an additional object of the present invention to provide an improved method for making a transparent soap bar having improved user properties.

According to a first aspect of the present invention there is provided a transparent soap composition in bar form comprising a soap mixture and a solvent system, the composition including with respect to the total composition 40 to 65 wt % of a soap mixture and 60 to 35 wt % of a solvent system, wherein the solvent system includes with respect to the total composition 5 to 15 wt % short chain ($C < 4$) monohydric alcohol or a mixture of said monohydric alcohols, 5 to 20 wt % water and 15 to 40 wt % of a mixture of trialkanolamine and polyol or blend of polyols the said trialkanolamine polyol mixture having a ratio in weight terms of trialkanolamine to polyol or polyols lying within the range 1:3 to 1:0.25, the total composition comprising not more than 20 wt % trialkanolamine, preferably not more than 16.9 wt % trialkanolamine.

We have found that the present composition provides a high quality transparent soap bar. In particular the present composition provides a transparent bar having a relatively high soap content which can ensure that user properties having regard to rate of wear, mush perception and the amount and quality of lather are similar to those associated with an ordinary opaque soap bar. In addition we believe that the presence of the short chain monohydric alcohol or alcohols makes an important contribution to user properties in as much as bars comprising the present composition do not tend to have a sticky surface initially and following contact with water. Although we do not wish to be bound by any theory we believe that the monohydric alcohol or alcohols in a soap bar comprising the present composition evaporates at a newly revealed surface of the bar following its use so as to provide a slightly dry outer layer and hence overcomes any tendency to stickiness that might otherwise be present. The present inclusion of alcohol in the composition differs from that included in the traditional casting method in that the alcohol is retained in the bar following its preparation. The difference between the traditional and the present compositions can be directly observed in their preparation in that in the traditional alcohol based compositions the bars as initially cast are semi-opaque and only turn transparent on evaporation of the alcohol, whereas the present bars can be made by allowing to cool an isotropic transparent melt of the composition directly to set transparent bars.

Suitable sources of soap are those conventionally employed in soap manufacture and include tallow, coconut oil, castor oil, rosin and other vegetable, animal and marine oils and blends of purified fatty acids. The maximum carbon chain length preferred is C22 and the minimum carbon chain length preferred is C6. Castor oil soap and rosin can be included if very transparent soap is required.

Preferably the soap mixture is selected so as to contain, with respect to the total soap content, at least 25 wt % saturated fatty acid soaps having a carbon chain length of at least 14. A preferred upper limit for such a soap fraction is of the order of 70 wt %, with respect to the total soap content, although it may depend on what other soap fractions are present. In general terms however the amount of saturated longer chain (C>14) fatty acid soaps present is selected having regard to the degree of firmness desired in use in the end bar product, it being these longer chain soaps to which firmness is generally attributed. Preferably also the soap mixture is selected to contain, with respect to the total soap content, at least 30 wt % of saturated fatty acid soaps having a carbon chain length of less than 14 or unsaturated fatty acid soaps or a mixture thereof. A preferred upper limit for such a fraction is about 75 wt %, with respect to the total soap content, although it may depend on other components present in the soap mixture. In general terms however this latter soluble soap fraction is believed to be responsible for the quality and quantity of lather achieved in use of the resulting soap bar and can thus be selected primarily having regard to the lather properties desired in the end product. If desired the present composition can contain one or more non-soap detergents in place of at least some of and/or in addition to the soap mixture.

The soap mixture can comprise all sodium soap. Preferably however about 10 to about 40 wt %, more preferably about 20 to about 30 wt %, of the soap mixture is a soap other than sodium. Preferred soaps other than sodium, are potassium and trialkanolamine, especially triethanolamine. The presence of these non-sodium soaps can increase the transparency of the finished product, particularly at overall high soap levels within the present range. Bars having a high level of soap can be preferable due to their increased firmness and other improved in use properties. Where triethanolamine soaps are included they are preferably provided by admixing a stoichiometric amount of triethanolamine with fatty acids, such as a 50:50 blend of palmitic and stearic acids.

Thus a preferred soap mixture complying with the above requirements is a blend of tallow and coconut sodium soaps in a ratio of 100:0 to 0:100 tallow to coconut, with a preferred ratio range between 50:50 to 82:18 tallow:coconut in combination with a triethanolamine or potassium soap derived from 50:50 palmitic:stearic blend, in a ratio of sodium soap to triethanolamine or potassium soap of 90:10 to 60:40, with a preferred ratio of 75:25.

The solvent system of the present invention has to follow the above requirements for the solvent in order to yield a transparent soap having a non-sticky and transparent surface appearance in use.

It is essential that the solvent system contains the said alcohol, trialkanolamine and polyol in the amounts given above in order to render the compositions containing the presently specified soap levels transparent and of good user properties. We believe that the presence of the presently specified short chain monohydric alcohol(s) in the solvent system permits the amount of trialkanolamine to be reduced compared to U.S. Pat No. 2820768. High levels of free trialkanolamine as advocated in U.S. Pat. No. 2820768 are generally undesirable in a toilet bar as the chemical is alkaline and can leave a dry after-wash feel on the skin in use and additionally we have found moreover that it is these very high levels of trialkanolamines that can cause stickiness of the bar in use.

The short chain (carbon length <4) monohydric alcohol or a mixture of such alcohols is preferably selected from the group comprising ethanol and isopropylalcohol. Ethanol is preferred as the only alcohol or as the major component in a mixture due to its evaporation characteristics and also its smell which can be readily masked, if desired by use of an appropriate perfume. The level of alcohol in the composition is preferably between 8 and 12 wt %, but depending on the other ingredients present in the composition.

The preferred trialkanolamine is triethanolamine. It is readily commercially available and has a smell that can be readily masked by perfume. Other trialkanolamines such as for example tri-isopropanolamine and tripropanolamine can however be employed. Monoalkanolamines and dialkanolamines in small quantities such as those present in commercially available samples of trialkanolamine may be present, the amount of trialkanolamine in the composition being calculated assuming that any mono- or dialkanolamines present are counted as trialkanolamine. Where a non-sodium soap is employed in the soap mixture which is a trialkanolamine soap, it is suitably the same trialkanolamine as employed in the solvent system.

The amount of trialkanolamine and of polyol or polyol blend present is preferably such that the ratio of trialkanolamine present in the solvent system to polyol or polyol blend lies within the range 1:2 to 1:0.5, more preferably within the range 1:1.7 to 1:0.8 with an optimum ratio being about 1:1.2. The total amount of trialkanolamine and polyol present preferably lies within the range 22 to 35 wt % with respect to the total bar composition. The presence of polyols is believed to help prevent any shrinkage of the bar in use.

By "polyol" we mean a generally non-volatile di- or higher polyhydric alcohol, a sugar or a polyethyleneglycol. Particular examples are propane-1,2, -diol, glycerol, sorbitol, sucrose and a polyethyleneglycol having an average molecular weight of about 400. Glycerol is preferred.

The water content of the solvent system preferably ranges from 7 to 15 wt %, with an optimum amount being about 12 wt %, with respect to the total composition. The precise amount will depend on the actual composition in any one case.

The soap composition can additionally contain small amounts of conventional additives, for example electrolytes, perfume, preservatives, dyes and pearlescent agents.

According to a second aspect of the present invention there is provided a method for making a transparent soap bar comprising forming a isotropic transparent melt of the present composition, casting the melt into moulds and allowing the melt to set.

In order to achieve an isotropic homogeneous and transparent melt the composition is preferably heated to a temperature of between 70° and 90° C. more preferably between 80° and 85° C., and maintained at such a raised temperature, below the boiling point of the solution, until all solids present have dissolved which is typically between 30 and 60 minutes e.g. 45 minutes. Suitably the cooling can take place at a rate determined by the ambient temperature. If desired however forced cooling can be employed.

Suitably the ingredients are added in the form in which they will be present in the final product. If however a particular composition includes a trialkanolamine soap then the starting materials to be added are preferably the equivalent fatty acids and their stoichiometric equivalent of trialkanolamine, which will preferably be present as a proportion of the total trialkanolamine required by the composition having regard to the solvent system. Sodium soaps can either be added as ready made or can be made in situ from fatty acids and sodium hydroxide.

Suitably any perfume and free fatty acids liable to thermal degradation may be added following any heating step and immediately prior to casting the melt into moulds.

Once at least partially set the composition can be removed from the moulds and subjected to any necessary finishing including, if necessary, cutting and if desired pressing into a desired final shape, followed by packaging.

Preferably however the melt is cast into individual moulds which additionally serve as a means of packaging the resulting soap bar. Removal of the bar from the mould will thus occur by the consumer immediately prior to use. Such an arrangement has the advantage that no mould removal or separate packaging step is necessarily required during manufacture. Suitably the mould can be filled fully with the melt and air-tightly sealed. The resulting bar can thus have an attractive shape and surface appearance determined by the shape and inner surface of the mould. Providing an air-tight seal additionally inhibits any tendency for any volatile components of the bar to escape during storage.

Examples of suitable moulds intended to act also as a package are rigid or semi-rigid plastic boxes such as those described in for example U.S. Pat. No. 3149188 and FR 910256. Alternatively and preferably the melt is cast into packs according to the invention disclosed in our co-pending patent application EP 88 311768.1. In this co-pending application is disclosed the use of a flexible film as the material from which the pack is made. The molten soap composition is cast directly into the pack which is then air-tightly sealed. The flexible film is preferable thermoplastic so that the heat of the melt causes the film pack to adjust to a wrinkle-free fit around the composition, which can if desired be lightly moulded during the time it is setting. The film is preferably transparent so that the resulting product displays the attractive transparency of the soap bar.

Throughout the present specification we mean by the word "transparent" a soap bar or composition such that bold face type of 14 point size can be readily read through a ¼ inch section of material. For further details of this test see U.S. Pat. No. 3274119.

Embodiments of the present invention will now be described by way of example only with reference to the following Examples:

EXAMPLE 1 to 3

Three formulations were prepared embodying the present invention. Details of the formulations in terms of wt % with respect to the final composition are given in Table I below from which it can be seen that Examples 1 and 2 differed only with respect to the ratio of triethanolamine and glycerol employed and that Examples 2 and 3 differed with respect to the type of sodium soap present. In each case the range of ingredients were melted together with stirring, excluding the perfume and the free fatty acids, and heated to 85° C. for 45 minutes. At the end of this period the perfume and free fatty acids were added and immediately following their intermixing the melt was poured into individual moulds and allowed to cool. In each case the melt was an isotropic transparent solution and set to a transparent solid.

TABLE I

| Example | 1 | 2 | 3 |
|---|---|---|---|
| Sodium soap* (anhydrous) | 37.0 | 37.0 | 37.0 |
| Palmitic Acid | 4.0 | 4.0 | 4.0 |
| Stearic Acid | 4.0 | 4.0 | 4.0 |
| Triethanolamine | 14.8 | 16.9 | 16.9 |
| Glycerol | 17.3 | 15.2 | 15.2 |
| Ethanol | 9.9 | 9.9 | 9.9 |
| Water | 11.8 | 11.8 | 11.8 |
| Perfume | 1.0 | 1.0 | 1.0 |
| Preservative | 0.2 | 0.2 | 0.2 |

*For Examples 1 and 2 the sodium soap was a 50:50 blend of soap derived from tallow and coconut oil respectively and for Example 3 the sodium soap was a 60:40 blend of soap derived from tallow and coconut oil respectively. Each of the sodium soaps used were made by saponification of the respective triglycerides or fatty acids by sodium hydroxide solution followed by washing with sodium chloride solution to that each soap typically contains about 0.5 wt % NaCl and 0.04% free NaOH.

The resulting bars were subjected to a series of tests in order to evaluate their in-use properties.

The bars were tested for lather, both subjectively for creaminess and volume and objectively in terms of lather volume, rate of wear, cracking and mushiness of the bar surface in use. The subjective lather testing was performed by an experienced panel freely hand-washing using the bars. Rate of wear, cracking and mushiness of the bar surface in use were assessed by washing down the bars at irregular intervals seven times daily over a four-day period and then examining and weighing the resulting bars. The mushing characteristics of the bars were additionally tested by immersing them in cold water for 2 hours and objectively measuring the resulting soft surface layer. For each test a control bar was also included comprising a conventional opaque extruded soap bar having a 86 wt % soap content derived from a blend comprising 82 wt % tallow soaps and 18 wt % coconut soaps.

Each bar was assessed and given a relative score rating in each test. The results are given in Table II below. For the scores relating to lather the higher the score recorded, the better the lather property. For the scores relating to rate of wear and mush the lower the score recorded the better the observed property.

TABLE II

| | Lather | | | | Mush | |
|---|---|---|---|---|---|---|
| | Volume | | Creami- | Rate of | | |
| Example | Obj | Subj | ness | Wear | Immersion | Washing |
| 1 | 39 | 0.98 | 0.96 | 27 | 17 | 0 |
| 2 | 39 | 0.94 | 0.88 | 33 | 10 | 7 |
| 3 | 30 | 0.77 | 1.27 | 29 | 12 | 8 |
| Control | 40 | 1.00 | 1.00 | 24 | 10 | 7 |

The results in Table II show that the present bars had in-use properties which could be described as nearly as good as those of the control. Each of the present bars passed the above transparency test and had a generally non-sticky surface in use. Example 2 had a greater transparency than Example 1 due to its higher triethanolamine:glycerol ratio.

EXAMPLE 4

A transparent bar was made following the procedure described in Examples 1 to 3, but using a formulation comprising 54 wt % of a soap mixture and 45 wt % of a solvent system. Details of the formulation are as follows:

| | | |
|---|---|---|
| Sodium soap* | 37 wt % | 54 wt % |
| Triethanolamine soap* | 17 wt % | |
| Water | 12 wt % | 45 wt % |
| Glycerol | 12 wt % | |
| Sorbitol | 4 wt % | |
| Ethanol | 10 wt % | |
| Free triethanolamine | 7 wt % | |
| Perfume | 1 wt % | |

*The 37 wt % sodium soap consisted of 9 wt % sodium soap derived from castor oil and 28 wt % of a 82:18 blend of sodium soap derived from tallow and coconut oil respectively. The 17 wt % triethanolamine soap consisted of a triethanolamine soap derived from a 50:50 blend of stearic and palmitic free fatty acids.

The resulting transparent bar was subjected to the test described under Examples 1 to 3 and was found to be slightly softer than any of the products of Examples 1 to 3 but to have improved transparency. These differences were attributed to the presence of the castor oil soap. The present bar however had equally good mush and lather characteristics and a non-sticky surface following its immersion in water.

EXAMPLES 5 to 10

A series of six soap compositions was prepared following the procedure given under Examples 1 to 3. Each of the present compositions varied only in their ratio of triethanolamine:glycerol content. The compositions of the series in terms of wt % are given in Table III below.

TABLE III

| Example | 5 | 6 | 7 | 8 | 9 | 10 |
|---|---|---|---|---|---|---|
| Sodium soap* | 37.0 | 37.0 | 37.0 | 37.0 | 37.0 | 37.0 |
| Palmitic Acid | 4.0 | 4.0 | 4.0 | 4.0 | 4.0 | 4.0 |
| Stearic Acid | 4.0 | 4.0 | 4.0 | 4.0 | 4.0 | 4.0 |
| Triethanolamine | 16.9 | 14.8 | 11.9 | 8.9 | 6.0 | 3.0 |
| Glycerol | 15.2 | 17.3 | 20.2 | 23.2 | 26.1 | 29.1 |
| Ethanol | 9.9 | 9.9 | 9.9 | 9.9 | 9.9 | 9.9 |
| Water | 11.8 | 11.8 | 11.8 | 11.8 | 11.8 | 11.8 |
| Perfume | 1.0 | 1.0 | 1.0 | 1.0 | 1.0 | 1.0 |
| Preservative | 0.2 | 0.2 | 0.2 | 0.2 | 0.2 | 0.2 |

*The sodium soap was a 82:18 mixture of tallow soap and coconut soap.

When assessed for transparency the bars were found to decrease in transparency through the series from Example 5 to Example 10 as the ratio of triethanolamine:glycerol decreased. Examples 5 to 7 met the above criterion for transparency while examples 8 to 10 i.e. bars having a ratio of triethanolamine:glycerol of less than 1:2 did not.

EXAMPLES 11 to 16

A series of six compositions was made following the procedure given under Examples 1 to 3. Each composition was the same as that given in Table III above for Examples 5 to 10 respectively, with the exception that sucrose was employed in place of glycerol in each case. Again as in the case of Examples 5 to 10 the transparency of the present bars decreased along the series from Example 11 to 16 with bars of Examples 11 to 13 being of acceptable transparency according to the above test and bars of Examples 14 to 16 i.e. bars having a ratio of less than 1:2 of triethanolamine to sucrose being of unacceptable transparency.

EXAMPLES 17 TO 22

A series of bars was made following the procedure given under Examples 1 to 3 and using the formulation given under Example 2, with the exception that the make-up of the sodium soap content was progressively changed from a 50:50 tallow:coconut soap content to a 25:25:50 stearate:palmitate:coconut soap content as shown in Table IV below.

TABLE IV

| Example | 17 | 18 | 19 | 20 | 21 | 22 |
|---|---|---|---|---|---|---|
| Sodium tallow soap | 50 | 40 | 30 | 20 | 10 | 0 |
| Sodium stearate | 0 | 5 | 10 | 15 | 20 | 25 |
| Sodium palmitate | 0 | 5 | 10 | 15 | 20 | 25 |
| Sodium coconut soap | 50 | 50 | 50 | 50 | 50 | 50 |

Each of the present bars was tested for lather volume objectively and for rate of wear as described under Examples 1 to 3 above and additionally for softness using a penetrometer. Each test was scored on a relative scale and the results are given in Table V below. For the lather score rating the higher the score recorded the better the lather property observed For the rate of wear and softeness score rating, the lower the score recorded, the more preferable the property achieved.

TABLE V

| Example | 17 | 18 | 19 | 20 | 21 | 22 |
|---|---|---|---|---|---|---|
| Lather volume | 33 | 29 | 29 | 27 | 21 | 18 |
| Rate of wear | 27 | 29 | 27 | 28 | 26 | 24 |
| Softness | 3.4 | 3.4 | 3.2 | 3.5 | 3.9 | 4.0 |

Thus the lather volume is seen to decrease and the softness of the bars is seen to increase as the series is progressed from Example 17 to Example 22 i.e. in decreasing content of sodium tallow soap. As sodium tallow soap essentially comprises 45 wt % of long chain unsaturated soap (mainly oleate) and 55 wt % of long chain saturated soap (mainly stearate, palmitate, myristate) Examples 17 to 22 illustrate the role of the long chain saturated soap in providing firmness in the bar and the role of the long chain unsaturated soap, in combination with the short chain saturated soaps provided by the sodium coconut soap, in boosting the lather volume of the bars.

EXAMPLES 23 to 26

A series of samples was prepared according to the procedure described under Examples 1 to 3 with the compositions in wt % given in Table VI below.

TABLE VI

| Example | 23 | 24 | 25 | 26 |
|---|---|---|---|---|
| Sodium soap* | 37.0 | 37.0 | 37.0 | 37.0 |
| Palmitic acid | 4.0 | 4.0 | 4.0 | 4.0 |
| Stearic acid | 4.0 | 4.0 | 4.0 | 4.0 |
| Triethanolamine | 16.9 | 16.9 | 16.9 | 16.9 |
| Glycerol | 15.2 | 15.2 | 15.2 | 15.2 |
| Ethanol | 9.9 | 7.0 | 5.0 | 3.0 |
| Water | 11.8 | 14.7 | 16.7 | 18.7 |
| Perfume | 1.0 | 1.0 | 1.0 | 1.0 |
| Preservative | 0.2 | 0.2 | 0.2 | 0.2 |

*The sodium soap was a 82:18 blend of sodium tallow soap and sodium coconut soap respectively.

Thus the bars comprising Examples 23 to 26 varied in composition only in respect of the ratio of ethanol to water present. In terms of transparency each of the bars of Examples 23 to 25 met the criterion for the above transparency test, but the transparency of the three samples nonetheless perceptibly decreased as the ethanol content decreased along the series Example 23 to Example 25 and the bar of Example 26 failed the above transparency test.

What is claimed is:

1. A transparent soap composition in bar form comprising with respect to the total composition 40 to 65 wt % of a soap mixture and 60 to 35 wt % of a solvent system, wherein the solvent system includes with respect to the total composition 5 to 12 wt % short chain (C<4) monohydric alcohol or a mixture of said monohydric alcohols, 5 to 20 wt % water and 15 to 40 wt % of a mixture of trialkanolamine and polyol or blend of polyols, the said trialkanolamine/polyol mixture having a ratio in weight terms of trialkanolamine to polyol or polyols lying within the range 1:3 to 1:0.25, the total composition comprising not more than 20 wt % trialkanolamine.

2. A composition according to claim 1 wherein the soap mixture contains, with respect to the total soap content, at least 25 wt % saturated fatty acid soaps having a carbon chain length of at least 14.

3. A composition according to claim 1 wherein the soap mixture contains, with respect to the total soap content, at least 30 wt % of saturated fatty acid soaps having a carbon chain length of less than 14 or unsaturated fatty acid soaps or a mixture thereof.

4. A composition according to claim 1 wherein the soap mixture comprises, with respect to the total soap content, 90 to 60 wt % of a sodium soap and 10 to 40 wt % of a trialkanolamine or potassium soap or mixture thereof.

5. A composition according to claim 1 wherein the polyol or polyol blend is present in an amount such that the ratio of trialkanolamine present in the solvent system to polyol or polyol blend lies within the range 1:2 to 1:0.5.

6. A composition according to claim 1 wherein the polyol in the solvent system is selected from the group consisting of a propane-1,2,-diol, glycerol, sorbitol, sucrose and polyethylene glycols having an average molecular weight of about 400.

7. A composition according claim 1 wherein the said alcohol in the solvent system is ethanol.

8. A composition according to claim 1 wherein the trialkanolamine present in the solvent system is triethanolamine.

9. A composition according to claim 1 wherein water is present in the solvent system at a level of between 7 and 15 wt % with respect to the total composition.

10. A method for making a transparent soap bar comprising forming an isotropic transparent melt of a composition according to claim 1, casting the melt into moulds and allowing the melt to set.

11. A method according to claim 10 wherein the melt is retained in the said moulds as an air-tight storage means.

12. A method according to claim 11 wherein the moulds are in the form of a pack comprising flexible film material.

13. A method according to claim 12 wherein the flexible film material is thermoplastic.

* * * * *